US008301065B2

(12) United States Patent
Nagao

(10) Patent No.: US 8,301,065 B2
(45) Date of Patent: Oct. 30, 2012

(54) IMAGE FORMING APPARATUS WITH SECONDARY TRANSFER SECTION HAVING RUBBER BACKUP ROLLER

(75) Inventor: Shinichi Nagao, Koganei (JP)

(73) Assignee: Konica Minolta Business Technologies, Inc. (JP)

( * ) Notice: Subject to any disclaimer, the term of this patent is extended or adjusted under 35 U.S.C. 154(b) by 38 days.

(21) Appl. No.: 12/951,538

(22) Filed: Nov. 22, 2010

(65) Prior Publication Data

US 2011/0129263 A1 Jun. 2, 2011

(30) Foreign Application Priority Data

Nov. 27, 2009 (JP) ..... 2009-269979

(51) Int. Cl.
*G03G 15/01* (2006.01)

(52) U.S. Cl. ..... 399/302

(58) Field of Classification Search ..... 399/66, 399/101, 162, 164, 302, 308
See application file for complete search history.

(56) References Cited

U.S. PATENT DOCUMENTS 6,298,212 B1 * 10/2001 Kono et al. ..... 399/302
7,937,016 B2 * 5/2011 Kamijo et al. ..... 399/98
2004/0247348 A1 * 12/2004 Kim et al. ..... 399/302
2007/0172265 A1 * 7/2007 Matayoshi ..... 399/302

FOREIGN PATENT DOCUMENTS

JP 09185267 A * 7/1997
JP 10240041 A * 9/1998
JP 11-268595 A 10/1999
JP 2003015442 A * 1/2003
JP 2007-264292 A 10/2007
JP 2007328275 A * 12/2007

* cited by examiner

*Primary Examiner* — Robert Beatty
(74) *Attorney, Agent, or Firm* — Cantor Colburn LLP

(57) ABSTRACT

An image forming apparatus including a secondary transfer section of a roller transfer method which transfers a toner image supported on an intermediate transfer belt onto a sheet of paper, wherein the image forming apparatus includes a transfer roller and a backup roller which suspends the above intermediate transfer belt, and opposes to the above transfer roller via the intermediate transfer belt, the surface of the above backup roller has Asker C hardness of 10 degrees or more and less than 45 degrees, and a driving roller driving the above intermediate transfer belt is arranged downstream of a primary transfer section transferring a toner image onto the intermediate transfer belt and upstream of the above secondary transfer section.

5 Claims, 3 Drawing Sheets

IMAGE FORMING APPARATUS WITH SECONDARY TRANSFER SECTION HAVING RUBBER BACKUP ROLLER

This application is based on Japanese Patent Application No. 2009-269979 filed on Nov. 27, 2009 with Japanese Patent Office, the entire content of which is hereby incorporated by reference.

BACKGROUND OF THE INVENTION

The technology field of the present invention relates to an image forming apparatus.

There has heretofore been known an image forming apparatus, which transfers a toner image on a photoreceptor onto an intermediate transfer body (an intermediate transfer belt), and then transfers the toner image, which have been transferred onto the intermediate transfer belt, onto a sheet of paper via a transfer section of a roller method (a secondary transfer section).

The transfer section of such a roller method had a transfer roller and a backup roller which faces the transfer roller, and had a problem that a speed of the intermediate transfer belt changes due to a shock at a time when a sheet of paper enters a nip portion between the transfer roller and the backup roller, resulting in unevenness of a printed image.

In order to prevent such unevenness, there has heretofore been known an apparatus in which a tension roller is arranged downstream of a primary transfer section which transfers a toner image on a photoreceptor onto an intermediate transfer belt and upstream of a secondary transfer section, thereby the speed fluctuation of the intermediate transfer belt is absorbed (refer, for example, to Japanese Patent Application Publication (hereinafter referred to as JP-A) No. H11-268595).

In addition, to prevent the similar unevenness, there has heretofore been known an apparatus in which a flywheel is arranged on an axis of a backup roller facing to a transfer roller of a secondary transfer section, thereby the speed fluctuation of the intermediate transfer belt is absorbed by the aforesaid flywheel to prevent the occurrence of the unevenness (refer, for example, to JP-A No. 2007-264292).

The conventional secondary transfer section and its problems will be described below to facilitate understanding of the present invention.

FIG. 3 is a schematic drawing of the conventional secondary transfer section.

The conventional secondary transfer section 6' is composed of a backup roller 44', a transfer roller 61' facing the backup roller 44' and is capable of nipping an intermediate transfer belt 4' and a sheet of paper P, a transfer power source 62', and a solenoid 63' which urges the transfer roller 61' toward the backup roller 44'.

While the sheet of paper P is passing through a nip portion n' between the backup roller 44' and the transfer roller 61', switches of the transfer power source 62' and an urging device 63' become ON to transfer a toner image supported on the intermediate transfer belt 4' onto the sheet of paper P.

The backup roller 44' is composed such that a solid rubber 443' is formed around a shaft 441', and fluorine resin 444', for example tetrafluoroethylene resin (PTFE poly-tetrafluoroethylene), is coated on the surface of the solid rubber 443'. Since the backup roller 44' is composed of the solid rubber 443' (for example, the Asker C hardness of about 65 degrees), the constitution of the backup roller 44' exhibits a less elasticity.

When a sheet of paper enters the nip portion n' at the transfer process, the leading edge $P_1$ of the sheet of paper pushes away the backup roller 44' and the transfer roller 61' to enter the nip portion n', and when the sheet of paper leaves the nip portion n', the backup roller 44' and the transfer roller 61', which had been pushed away, come back to the original positions.

Due to the above reason, in the case where a sheet of paper is particularly thick (for example, a basis weight of about 300 g/m$^2$ or more) and the elasticity of the backup roller 44' is low as was described above, a shock is generated at a time when the sheet of paper enters and leaves the nip portion to cause a large fluctuation of a circling rate of the intermediate transfer belt 4'.

This generation of the shock is similar to a phenomenon which happens when we get on and get off a bump with a bicycle, if air pressure of the tire is high, we feel a shock, and if air pressure is low, we do not feel the shock.

The large fluctuation of a circling rate of the intermediate transfer belt 4' affects also to the upstream side (for example, a primary transfer section 5'), and causes difference in speed between a photoreceptor 1' rotating at a nearly constant rate and the intermediate transfer belt 4'. As a result, the large fluctuation causes a problem of generating unevenness of a printed image.

Hereinafter, the unevenness of a printed image, caused by difference of speed between a photoreceptor and an intermediate transfer belt at a time when the sheet of paper enters and leaves the nip portion, is referred to as a shock jitter.

However, the secondary transfer section described in JP-A No. H11-268595 had a problem such that unevenness of printed image occurred due to a shock at a time when a sheet entered the above nip portion (the shock jitter). Therefore, a tension roller had to be arranged to absorb the shock to prevent the occurrence of the aforesaid unevenness, which then led to a larger and more complicated apparatus, resulting in a problem of increase in failure frequency and in a manufacturing cost due to an increase in number of parts.

Further, the secondary transfer section described in JP-A No. 2007-264292 had a problem such that unevenness of printed image occurred due to a shock at a time when a sheet entered the above nip portion (the shock jitter). Therefore, a flywheel had to be arranged to absorb the shock to prevent the occurrence of the aforesaid unevenness, which then led to a larger and more complicated apparatus, resulting in a problem of increase in failure frequency and in a manufacturing cost due to an increase in number of parts.

In view of the foregoing problems, an object of the present invention is to provide an image forming apparatus which is small, relatively trouble-free and low manufacturing cost, and is capable of outputting a high-quality printed image.

SUMMARY

To realize at least one of the above-described objects, the image forming apparatus reflecting one aspect of the present invention comprises the followings.

An image forming apparatus including:

an intermediate transfer belt;

a primary transfer section which transfers a toner image onto the intermediate transfer belt;

a secondary transfer section which comprises a transfer roller and a backup roller and which transfers the toner image held on the intermediate transfer belt onto a sheet, the backup roller suspending the intermediate transfer belt and being opposed to the transfer roller with the intermediate transfer belt positioned between the transfer roller and the backup roller; and a driving roller which is arranged downstream of the primary transfer section and upstream of the secondary transfer section in a moving direction of the intermediate transfer belt and which drives the intermediate transfer belt, wherein a surface of the backup roller has Asker C hardness of 10 degrees or more, and less than 45 degrees.

DETAILED DESCRIPTION OF THE PREFERRED EMBODIMENT

Hereinafter the present invention will be described, but the present invention is not limited to the embodiments described below.

Figure 1:
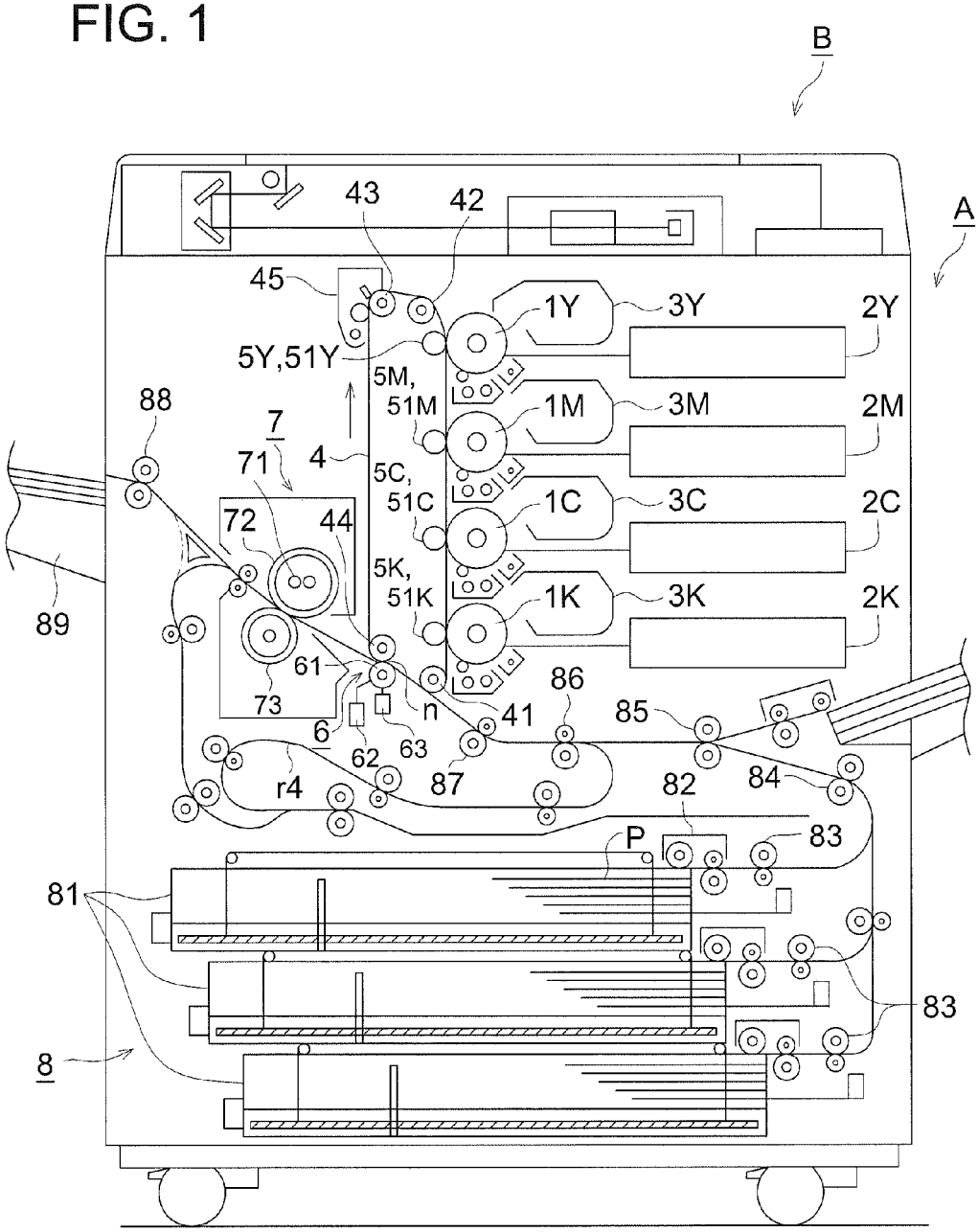
FIG. 1 is a cross section viewed from a side of an image forming apparatus.

FIG. 1 is a cross section viewed from a side of an image forming apparatus.

Before turning to the specific description, terms will be described. The terms "upstream" and "downstream" relating to a flow of a sheet of paper indicate directions from which and to which a sheet of paper flows, respectively. The terms "upstream" and "downstream" relating to an intermediate transfer belt indicate directions from which and to which a point on a circling intermediate transfer belt moves, respectively. The term "circling" indicates that an intermediate transfer belt suspended by rollers turns.

An image forming apparatus A is referred to as a tandem type color image forming apparatus. In the upper part of the image forming apparatus A, there is arranged an original document reading device B which reads image information of an original document.

The original document reading device B scans an original document via an optical system of an original document scanning unit, and outputs image information corresponding to the original document onto the image forming apparatus A.

The image forming apparatus A comprises exposure units 2 (2Y, 2M, 2C and 2K) which form latent images on photoreceptors 1 (1Y, 1M, 1C and 1K) based on the above image information, development units 3 (3Y, 3M, 3C and 3K) which visualize the latent images formed on the photoreceptor 1, a charging unit and a cleaning unit (both of which have no numbers on the figure) which are disposed around the photoreceptor drum, a primary transfer sections 5 (5Y, 5M, 5C and 5K) which transfer toner images supported on the photoreceptor 1 (1Y, 1M, 1C and 1K) onto an intermediate transfer belt 4, a secondary transfer unit 6 which transfers toner images supported on the intermediate transfer belt 4 onto a sheet of paper P, a fixing unit 7 which fixes the toner images transferred onto the sheet of paper P, and a sheet feeding unit 8 which has multiple sheet cassettes 81 and supplies sheets of paper from the sheet cassette.

The letters Y, M, C and K which are added after reference numerals indicate a color. For example, 1Y, 1M, 1C and 1K indicate photoreceptors for yellow (Y), magenta (M), cyan (C) and black (K), respectively. Hereinafter, in the case where a photoreceptor does not relate to a specific color, photoreceptors (1Y, 1M, 1C and 1K), for example, are simply denoted as a photoreceptor 1.

Hereinafter, each constitution will be described.

Image information (an analogue signal) read by the original document reading device B is subjected, at an image processing section (not illustrated), to an analogue processing, an A/D conversion, a shading compensation, an image compression processing, and the like, and thereafter the analogue signal is inputted into the exposure unit 2 as digital image information signals.

The exposure unit 2 modulates and scans laser light based on digital image information signals, to form latent images on the surface of the photoreceptor 1.

The development unit 3 makes the latent image visible using a two-component developer composed of small particle size toners of yellow (Y), magenta (M), cyan (C) and black (K), and carrier, to form toner image on the surface of the photoreceptor 1.

The primary transfer section 5 successively transfers toner images formed on the surface of the photoreceptor 1 onto the intermediate transfer belt 4 by the primary transfer roller 51 (a primary transfer), to compose color images on the surface of the intermediate transfer belt 4.

The intermediate transfer belt 4, exhibiting semi-conductivity and having an endless belt shape, is suspended by a driving roller 41, driven rollers 42 and 43, and a backup roller 44 composing a part of the secondary transfer section 6, and is driven to the arrow direction by the driving roller 41.

The driving roller 41 is arranged downstream of the primary transfer section 5 and upstream of the secondary transfer section 6 (the backup roller 44).

The secondary transfer section 6 is composed of a backup roller 44, a transfer roller 61 which is located facing the backup roller 44 and is capable of nipping the intermediate transfer belt 4 and the sheet of paper P, a transfer power source 62, and an urging device (for example a solenoid) 63 which urges the transfer roller 61 toward the backup roller 44, and, while the sheet of paper P is passing through a nip portion "n" between the backup roller 44 and the transfer roller 61, switches of the transfer power source 62 and the urging device 63 are turned ON to transfer toner images supported on the intermediate transfer belt 4 onto the sheet of paper P.

The sheet of paper P, which has been stored in the sheet cassette 81 of the sheet feeding unit 8, and has been picked out by the sheet feeding device 82, is conveyed to the nip portion "n" by conveyance rollers 83, 84, 85 and 86, which convey the sheet of paper, and a registration roller 87. Then, at the nip portion "n", the toner images supported on the intermediate transfer belt 4 are transferred onto the sheet of paper P.

The sheet of paper P, onto which the toner images have been transferred, is heated and pressed at the fixing unit 7 by the heat roller 72, in which the heat lamp which is a heat source, is furnished, and the pressure roller 73, and then as a result, the toner images on the sheet of paper P are fixed on the sheet of paper P.

The sheet of paper P, on which toner images have been fixed, is discharged onto the elevating sheet discharge tray 89 by being held by discharge rollers 88. The elevating sheet discharge tray 89 goes up and down so that a sheet of paper being discharged may not be blocked by the uppermost part of the loaded sheets of paper by a lifting and lowering means (not illustrated) which lifts and lowers the elevating sheet discharge fray 89.

After the intermediate transfer belt 4 transfers the toner images onto the sheet of paper P, the sheet of paper P is separated by using a curvature of the belt. Then, the residual toners on the intermediate transfer belt 4 are removed by a cleaning unit 45.

The cleaning unit 45 is located upstream of the primary transfer section 5 (downstream of the secondary transfer section 6). It makes hard to transmit influence of load fluctuation of the cleaning section 45 (for example, a cleaning blade (not illustrated)) to the primary transfer section 5 by arranging the cleaning unit 45 upstream of the primary transfer section 5.

Figure 2:
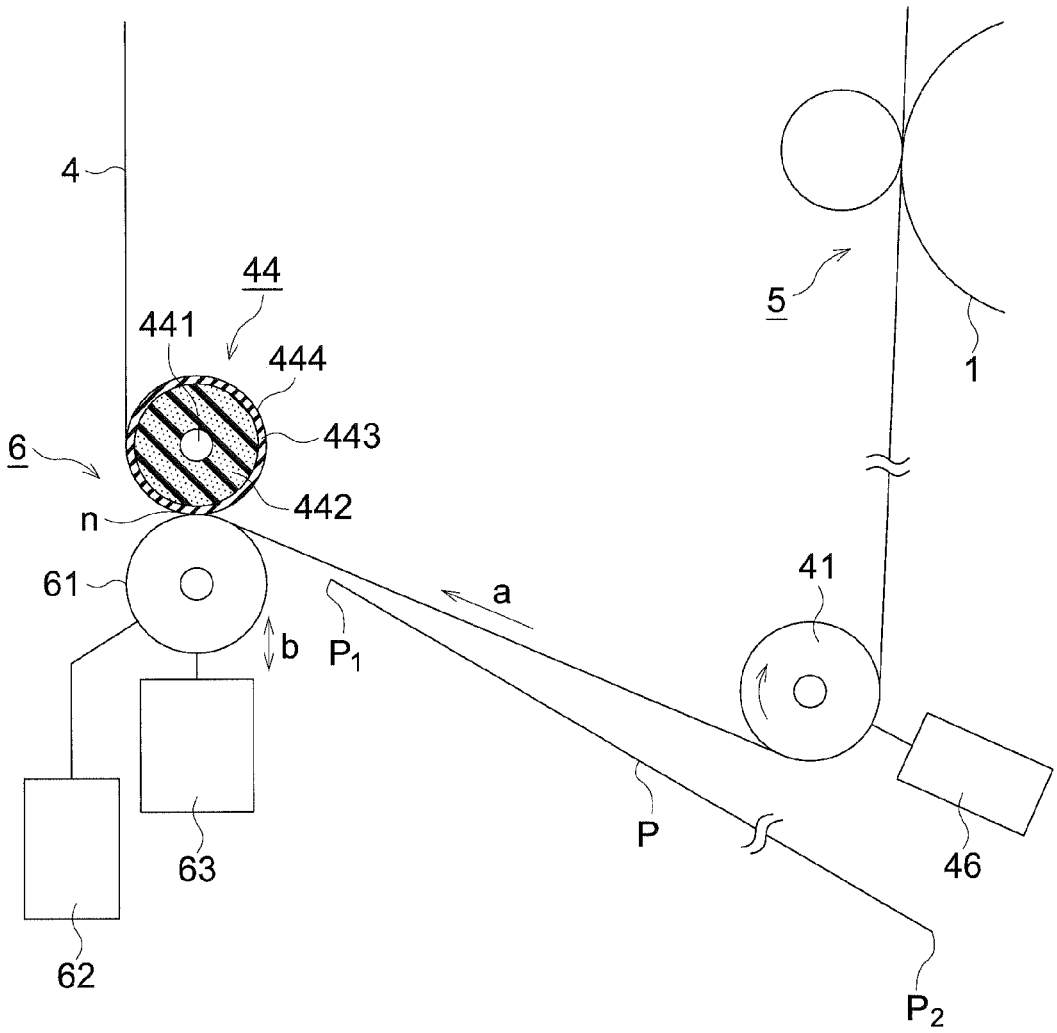
FIG. 2 is a schematic diagram of a secondary transfer section.

FIG. 2 is a schematic diagram of the secondary transfer section of an embodiment of the present invention.

The secondary transfer section 6 of a roller transfer method is composed of the backup roller 44, the transfer roller 61 facing the backup roller 44 and is capable of nipping the intermediate transfer belt 4 and the sheet of paper P, the transfer power source 62, and the urging device 63 (for example, the solenoid 63) which urges the transfer roller 61 toward the backup roller 44.

While the sheet of paper P is passing through a nip portion "n" between the backup roller 44 and the transfer roller 61, switches of the transfer power source 62 and the urging device 63 are kept ON to transfer toner images supported on the intermediate transfer belt 4, onto the sheet of paper P.

The intermediate transfer belt 4 is suspended by the driving roller 41 which drives the intermediate transfer belt 4, the backup roller 44, driven rollers 42, and the like, and is driven to the arrow direction "a" by a motor 46 which is connected to the driving roller 41 and drives the driving roller rotatively.

The backup roller 44 is composed such that a sponge rubber 442 and a solid rubber 443 are formed on a shaft 441 in this order, and the outer circumferential surface of the solid rubber 443 is covered by fluorine resin 444, for example, poly tetra fluoro ethylene resin (PTFE). The backup roller 44 exhibits elasticity due to elasticity of the sponge rubber 442.

The backup roller 44 has no driving unit and is driven by a circling of the intermediate transfer belt 4. The solid rubber 443 has a thickness of 1 to 2 mm, and protects the sponge rubber 442 from damage by an external force.

The transfer roller 61, made of metal, is electrically connected to the transfer power source 62, and is mechanically connected to an urging device (for example, a solenoid) 63 (hereinafter, an urging device 63 is referred to as a solenoid 63) so that the transfer roller 61 is detachably/attachably urged (an arrow "b") to the backup roller 44.

From some time before a prescribed time when the sheet of paper P arrives at the nip portion "n" until the sheet of paper P finishes passing through the nip portion "n", the transfer roller 61 is urged toward the backup roller 44 by the solenoid 63, and while the sheet of paper P is passing through the nip portion "n", the toner images, which are supported by the intermediate transfer belt 4, are transferred onto the sheet of paper P by the transfer power source 62.

When the leading edge $P_1$ of the sheet of paper P enters the nip portion "n", the backup roller 44 is easily dented due to elasticity of the sponge rubber 442 to cause no significant shock. As a result, no significant speed fluctuation of the intermediate transfer belt 4 is caused.

When the trailing edge $P_2$ of the sheet of paper P leaves the nip portion "n", the backup roller 44 comes back to the original shape. Also at this time, no significant shock is generated due to elasticity of the sponge rubber 442. As a result, no significant speed fluctuation of the intermediate transfer belt 4 is caused.

As described above, since the speed fluctuation of the intermediate transfer belt 4 becomes small, there is also reduced effect on the primary transfer section 5 which is located upstream of the secondary transfer section 6, and as a result, generation of the shock jitter is restrained.

Especially, even in the case of thick sheet of paper (for example, a basis weight of 300 g/m$^2$ or more), no significant shock is caused due to elasticity of the sponge rubber 442 to result in no occurrence of significant speed fluctuation of the intermediate transfer belt 4. Therefore, there is also reduced effect on the primary transfer section 5 located upstream of the secondary transfer section 6, and as a result, generation of the shock jitter is restrained.

The elasticity of the surface of the backup roller 44 is the Asker C hardness of less than 45 degrees as will be described in an example later, and 10 degrees or more in view of manufacturing of the roller (if the roller is excessively soft, it is unable to maintain a shape of the roller, or a roller having a uniform diameter cannot be manufactured). The Asker C hardness is preferably less than 40 degrees and of 10 degrees or more.

The sponge rubber 442 and the solid rubber 443 are selected to have hardness such that the Asker C hardness of the surface of the backup roller 44 becomes less than 45 degrees and 10 degrees or more.

As described above, by providing the backup roller 44 with a prescribed hardness, in other words elasticity, when the sheet of paper P enters and leaves the nip portion "n", impulsive speed fluctuation of the intermediate transfer belt 4 is restrained, and as a result, it becomes possible to provide a high quality image having no shock jitters. Further, by providing the backup roller 44 with a prescribed hardness, in other words elasticity, it becomes possible to provide an image forming apparatus having a simple structure (relatively trouble free and lower manufacturing cost) such that there is no need of a complicated mechanism to restrain impulsive speed fluctuation of the intermediate transfer belt 4.

In the case where the backup roller 44 is Allowed to have elasticity by forming the backup roller 44 by using the sponge rubber 442 and the solid rubber 443, it becomes difficult in manufacturing to make the periphery of the backup roller 44 a perfect circle. Therefore, a slight speed fluctuation of the intermediate transfer belt 4 at the nip portion "n" is likely to be caused, compared to the backup roller 44 having a rigid body (a perfect circle), even for a period other than when the sheet of paper P enters or leaves the nip portion "n".

When such speed fluctuation of the intermediate transfer belt 4 is caused, there may be a case where the above speed fluctuation causes speed fluctuation of the photoreceptor 1 which rotates while contacting the intermediate transfer belt 4 to cause unevenness of latent image (color registration error) due to failure of synchronization between rotation of the photoreceptor 1 and exposure by the exposure unit 2.

To control speed fluctuation of the intermediate transfer belt 4 at the primary transfer section 5, which becomes main causes of the shock jitter and the color registration error as described above, the drive roller 41 is arranged upstream of the secondary transfer section 6 (the backup roller 44) and downstream of the primary transfer section 5 so that tension of the intermediate transfer belt 4 between the backup roller 44 and the drive roller 41 is relieved to make it possible to absorb speed fluctuation of the intermediate transfer belt 4 due to the secondary transfer section 6, and tension of the intermediate transfer belt 4 between the drive roller 41 and the primary transfer section 5 is increased to prevent the speed fluctuation of the intermediate transfer belt 4 at the primary transfer section 5.

As described above, it becomes possible to supply a high quality image having no shock jitter or color registration error by making it possible to absorb speed fluctuation of the intermediate transfer belt 4 and preventing the speed fluctuation of the intermediate transfer belt 4 at the primary transfer section 5, by providing the backup roller 44 with elasticity and driving the intermediate transfer belt 4 at upstream side of the secondary transfer section 6 (the backup roller 44) and at the downstream side of the primary transfer section 5.

EXAMPLES

Into an image forming apparatus having the secondary transfer section 6 shown in FIG. 2, the backup rollers 44 having different hardness were incorporated one by one, and then, a test chart was printed on sheets of paper having a basis weight of 300 g/m$^2$. Using these printed sheets, evaluation on the shock jitter of the printed image was carried out for each of backup rollers being installed, results of which are described below with reference to Table 1.

TABLE 1

| Hardness of Backup Roller (degrees) | Generation of Jitter |
|---|---|
| 45 or more and less than 50 | C |
| 40 or more and less than 45 | B |
| 35 or more and less than 40 | A |
| 30 or more and less than 35 | A |
| 25 or more and less than 30 | A |
| 20 or more and less than 25 | A |
| 15 or more and less than 20 | A |
| 10 or more and less than 15 | A |

The evaluation of the shock jitter was carried out as follows. Narrow lines of 42 μm in width (for example, a black line) were printed on the almost entire surface of a sheet of paper at intervals of 169 μm in a direction (the main scanning direction) perpendicular to the sheet conveyance direction (the sub-scanning direction), and then the pitches of the printed narrow lines were measured using a loupe. Using the measured values, the pitch variation values Δp % were calculated, and then, the size of the shock jitter was decided based on the size of the pitch variation values Δp %.

For example, if the measured pitch of the narrow lines, at a part where the shock jitter was generated or is possibly generated, which is attributable to speed fluctuation of the intermediate transfer belt 4 generated at a time when a sheet of paper enters and leaves the nip portion, is assumed to be p2 (μm), and the measured pitch of the narrow lines, at the regular part other than this, is assumed to be p1 (μm), the pitch variation value Δp % is expressed by a formula below.

$$\Delta p=\{|p1-p2|/p1\}\times 100(\%)$$

In the case where the pitch variation value was 2.5% or more, the print was rated Grade C since unevenness was recognized in the printed image; in the ease where the pitch variation value was less than 2.5% and 2.0% or more, the print was rated Grade B since the print had practically no problem even if unevenness was recognized; and in the case where the pitch variation value was less than 2.0%, the print was rated Grade A since unevenness was hard to be recognized.

The hardness of the backup roller was determined in such a way that the Asker C hardness in a diameter direction of a roller was measured for a total of 12 sampling points determined by three sampling points in the axis direction and four sampling points in the circumferential direction, using a durometer (a spring-type hardness meter), which is stipulated in SRISO101 (the Society of Rubber Industry Standards in Japan), and then an average of the measured hardness values was calculated, and was taken as the hardness of the roller.

In Table 1, the left column shows hardness (the Asker C hardness) of the backup roller 44, and the right column shows evaluation results on shock jitter of the aforesaid backup roller.

In Table 1, it was confirmed that when the hardness of the backup roller 44 was 45 degrees or more and less than 50 degrees, pitch unevenness (jitter), which was a practical problem, was generated, but when it was 40 degrees or more and less than 45 degrees, the pitch unevenness was lower than a level of practical problem, and further, when it was less than 40 degrees and 10 degrees or more, the unevenness was hard to be recognized.

Based on the above results, the hardness of the backup roller 44 is specified as less than 45 degrees and 10 degrees or more in the Asker C hardness, and preferably less than 40 degrees and 10 degrees or more.

Regarding the color registration error, it has been understood that the higher hardness a roller has as the backup roller of the transfer roller, the less problem the printed image has. Therefore, confirmation was carried out whether there was a problem even if the above-described roller having low hardness was used.

Evaluation on the color registration error of printed images, which were made by printing a test chart on sheets of paper having a basis weight of 300 g/m$^2$, was carried out in the image forming apparatus of FIG. 1 by changing hardness values of a backup roller and positions where an intermediate transfer belt was driven. The results are described below with reference to Table 2.

Figure 3:
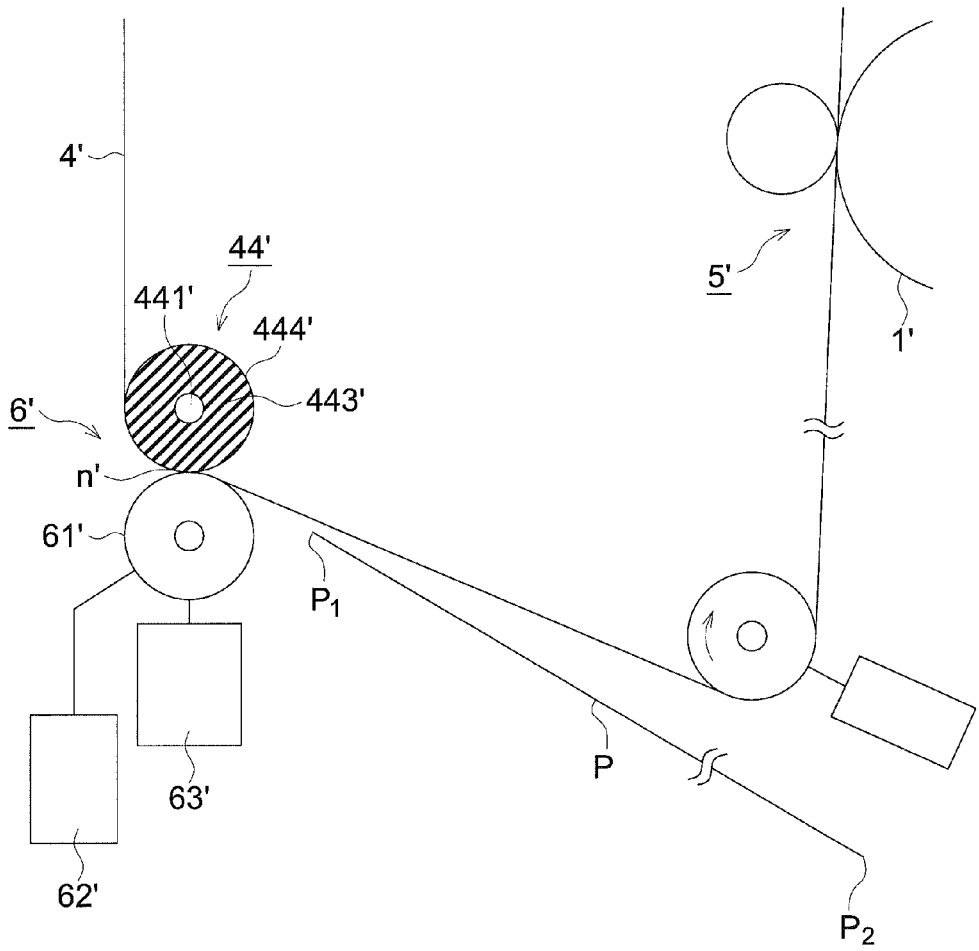
FIG. 3 PRIOR ART
FIG. 3 is a schematic diagram of a conventional secondary transfer section.

Specifically, the backup roller having the Asker C hardness of 40 degrees (sponge rubber-based) which is shown in FIG. 3, and the backup roller having the Asker C hardness of 65 degrees (solid rubber-based) which is shown in FIG. 2, were combined with a case where the drive roller 41 was arranged downstream of the primary transfer section 5 and upstream of the secondary transfer section 6, and the intermediate transfer belt 4 was driven by the drive roller 41 as shown in FIG. 1, and a case where the drive roller 41' (not illustrated) was arranged upstream of the primary transfer section 5 and downstream of the secondary transfer section 6 (for example, at the position of driven roller 43), and the intermediate transfer belt 4 was driven by the drive roller 41', and then evaluation thereof was carried out.

In the case where the drive roller 41' was arranged upstream of the primary transfer section 5 and downstream of the secondary transfer section 6, a simple driven roller was arranged at the position where the drive roller 41, which was shown in FIG. 1, was arranged, and the drive roller 41' was arranged at the position of the driven roller 43.

Evaluation of the color registration error was carried out in such manner that black, yellow, magenta, and cyan narrow line images, which were printed based on identical position data in the sub-scanning direction, were set as one unit, and many of the aforesaid units were printed on almost the entire surface of one sheet of paper based on another different identical position data in sub-scanning direction.

An amount of position shift in the sub-scanning direction of yellow, magenta, and cyan narrow line images with respect to the black narrow line images for multiple printed units was measured using a loupe, whereby color registration error values ΔKY', ΔKM', ΔKC' of each narrow line of color with respect to the black narrow line were calculated, and then the color registration error value was decided.

Specifically, a black narrow line of 42 μm in width and yellow, magenta and cyan narrow lines of 42 μmin width based on the identical data as the sub-scanning direction data of the black narrow line, each of which was printed to be arranged at lateral locations of the black narrow line in the main scanning direction were combined as one unit, and then the aforesaid units were printed at intervals of about 5 mm in the sub-scanning direction of the sheet of paper (for example, 54 units in A4 size) and further in the main scanning direction of the sheet, for example at 3 locations, that is, in the vicinity of left edge, in the center, and in the vicinity of right edge (for example, 162 units as a total in A4 size) to form an image of a test chart.

Each of position shifts in the sub-scanning direction of the yellow, magenta and cyan narrow lines with respect to the black narrow line in each unit is measured. The average measured value of each color is taken as a color registration error value for each color.

If each of position shifts of the yellow, magenta and cyan narrow lines with respect to the black narrow line of any unit is designated as ΔKY(i) μm, ΔKM(i) μm and ΔKC(i) μm, each of the color registration error values, ΔKY', ΔKM' and ΔKC', is represented by the following formulae: where "n" is a number of samples, and in case of A4 size, the "n" is 162.

$$\Delta KY' = \sum_{i=1}^{n} \Delta KY(i)/n(\mu\text{m})$$

$$\Delta KM' = \sum_{i=1}^{n} \Delta KM(i)/n(\mu\text{m})$$

$$\Delta KC' = \sum_{i=1}^{n} \Delta KC(i)/n(\mu\text{m})$$

In the case of the color registration error value being 70 μm or more, the print was rated Grade C since unevenness in the printed image was recognized, and in the case of less than 70 μm, the print was rated Grade A since no unevenness was recognized.

TABLE 2

| Driving Location of Intermediate Transfer Belt | Backup Roller | |
|---|---|---|
| | Solid Rubber-based (Hardness is 65 degrees) | Sponge Rubber-based (Hardness is 40 degrees) |
| Upstream of Primary Transfer Section 5 and Downstream of Secondary Transfer Section 6 | A | B |
| Downstream of Primary Transfer Section 5 and Upstream of Secondary Transfer Section 6 | A | A |

in Table 2, it was found that, in both cases where the intermediate transfer belt 4 was driven by the driving roller 41 by arranging the driving roller 41 downstream of the primary transfer section 5 and upstream of the secondary transfer section 6, and where the intermediate transfer belt 4 was driven by the driving roller 41' (not illustrated) by arranging the driving roller 41' upstream of the primary transfer section 5 and downstream of the secondary transfer section 6, the backup roller having the Asker C hardness of 65 degrees (solid rubber-based) was rated Grade A indicating no generation of color registration error.

Further, it was found that, in the case where the intermediate transfer belt 4 was driven by the driving roller 41 by arranging the driving roller 41 downstream of the primary transfer section 5 and upstream of the secondary transfer section 6, the backup roller having the Asker C hardness of 40 degrees (sponge rubber-based) was rated Grade A indicating no generation of color registration error. However, in the case where the intermediate transfer belt 4 was driven by the driving roller 41' (not illustrated) by arranging the driving roller 41' upstream of the primary transfer section 5 and downstream of the secondary transfer section 6, the above backup roller generated color registration error, even though it had no practical problem (Grade B).

According to the above, it was confirmed that both of shock jitter and color registration error could be prevented in the present embodiment in which, using a backup roller (sponge rubber-based) having a low hardness, for example, the Asker C hardness of 40 degrees, the intermediate transfer belt 4 was driven by the driving roller 41 by arranging the driving roller 41 downstream of the primary transfer section 5 and upstream of the secondary transfer section 6.

According to the above embodiments of the invention, there can be provided an image forming apparatus which is small, relatively trouble-free and low manufacturing cost, and is capable of outputting a high-quality printed image.

What is claimed is:

1. An image forming apparatus comprising:

an intermediate transfer belt;

a primary transfer section which transfers a toner image onto the intermediate transfer belt;

a secondary transfer section which comprises a transfer roller and a backup roller and which transfers the toner image held on the intermediate transfer belt onto a sheet, the backup roller suspending the intermediate transfer belt and being opposed to the transfer roller with the intermediate transfer belt positioned between the transfer roller and the backup roller; and a driving roller which is arranged downstream of the primary transfer section and upstream of the secondary transfer section in a moving direction of the intermediate transfer belt and which drives the intermediate transfer belt, wherein the backup roller comprises sponge rubber and solid rubber formed on the sponge rubber, and a surface of the backup roller has Asker C hardness of 10 degrees or more, and less than 45 degrees.

2. The image forming apparatus of claim 1, wherein the surface of the backup roller has Asker C hardness of 10 degrees or more, and less than 40 degrees.

3. The image forming apparatus of claim 1, wherein the backup roller further comprises fluorine resin coated on the solid rubber.

4. The image forming apparatus of claim 1, further comprising:

a cleaning unit which is positioned upstream of the primary transfer section in the moving direction of the intermediate transfer belt and which cleans the intermediate transfer belt.

5. The image forming apparatus of claim 1, for forming a color image, which comprises a plurality of primary transfer sections and which composes a color image on the intermediate transfer belt by transferring toner images by the plurality of primary transfer sections.

* * * * *